US009021618B2

(12) United States Patent
Kaviani et al.

(10) Patent No.: US 9,021,618 B2
(45) Date of Patent: May 5, 2015

(54) AIR-CUSHIONED SHORTS FOR CYCLING

(71) Applicants: Ray Kaviani, Woodland Hills, CA (US); Behzad Bavarian, Northridge, CA (US)

(72) Inventors: Ray Kaviani, Woodland Hills, CA (US); Behzad Bavarian, Northridge, CA (US)

( * ) Notice: Subject to any disclaimer, the term of this patent is extended or adjusted under 35 U.S.C. 154(b) by 89 days.

(21) Appl. No.: 13/789,456

(22) Filed: Mar. 7, 2013

(65) Prior Publication Data

US 2014/0250567 A1 Sep. 11, 2014

(51) Int. Cl.
*A41D 1/08* (2006.01)

(52) U.S. Cl.
CPC ..... *A41D 1/084* (2013.01)

(58) Field of Classification Search
CPC ..... A63B 71/1216; A41D 1/084; A41D 13/0537; A41D 13/0155
USPC ..... 2/466, 267, 228, 227, DIG. 3
See application file for complete search history.

(56) References Cited

U.S. PATENT DOCUMENTS

| | | | | | |
|---|---|---|---|---|---|
| 1,468,072 | A | * | 9/1923 | Ogle | 128/889 |
| 2,446,006 | A | * | 7/1948 | Hendricks | 2/467 |
| 4,422,183 | A | * | 12/1983 | Landi et al. | 2/455 |
| 4,805,243 | A | * | 2/1989 | Gibbens et al. | 2/228 |
| 4,945,571 | A | * | 8/1990 | Calvert | 2/467 |
| 4,961,233 | A | * | 10/1990 | Black | 2/228 |
| 4,969,216 | A | * | 11/1990 | Guelli | 2/400 |
| 4,991,230 | A | * | 2/1991 | Vacanti | 2/455 |
| 5,086,514 | A | * | 2/1992 | Ross | 2/467 |
| 5,103,505 | A | * | 4/1992 | Llorens | 2/400 |
| 5,168,576 | A | * | 12/1992 | Krent et al. | 2/456 |
| 5,210,877 | A | * | 5/1993 | Newman | 2/456 |
| 5,257,418 | A | * | 11/1993 | Jaskiewicz | 2/20 |
| 5,271,101 | A | * | 12/1993 | Speth et al. | 2/228 |
| 5,282,277 | A | * | 2/1994 | Onozawa | 2/69 |
| RE34,573 | E | * | 4/1994 | Calvert | 2/467 |
| 5,330,249 | A | * | 7/1994 | Weber et al. | 297/214 |
| 5,419,612 | A | * | 5/1995 | Rassekhi | 297/200 |
| 5,551,082 | A | * | 9/1996 | Stewart et al. | 2/465 |
| 5,558,395 | A | * | 9/1996 | Huang | 297/199 |
| 5,689,836 | A | * | 11/1997 | Fee et al. | 2/465 |
| 5,918,309 | A | * | 7/1999 | Bachner, Jr. | 2/2.5 |
| 6,029,281 | A | * | 2/2000 | Battley | 2/406 |
| 6,070,273 | A | * | 6/2000 | Sgro | 2/455 |
| 6,079,056 | A | * | 6/2000 | Fogelberg | 2/461 |
| 6,327,715 | B1 | * | 12/2001 | Castiglione | 2/267 |
| 6,345,396 | B1 | * | 2/2002 | Schuler | 2/467 |
| 6,393,618 | B2 | * | 5/2002 | Garneau | 2/228 |
| 6,460,195 | B2 | * | 10/2002 | Wang | 2/228 |
| 6,519,781 | B1 | * | 2/2003 | Berns | 2/267 |
| 6,565,702 | B1 | * | 5/2003 | Forsyth et al. | 156/308.4 |
| 6,687,917 | B2 | * | 2/2004 | Forsyth et al. | 2/228 |
| 6,928,665 | B1 | * | 8/2005 | Yates | 2/466 |
| 6,990,693 | B2 | * | 1/2006 | Reschewitz | 2/228 |

(Continued)

*Primary Examiner* — Danny Worrell
(74) *Attorney, Agent, or Firm* — Colin P. Abrahams

(57) ABSTRACT

Cycling shorts for protecting a rider from harmful effects occasioned by the design of the substantially unpadded seat of a racing-type cycle. Fabric shorts of conventional or elongated design include a interior protective pad. The pad includes adjoined seat and crotch sections and is symmetrical with respect to an axis of symmetry. It includes an interior chamber for receiving pressurized air. A pump for delivering selectively pressurized air communicates with the interior chamber by means of a conduit. The chamber includes internally honeycombed sections for minimizing air flow so that the cushioning effect of the pad is preserved despite the force exerted by the weight of a wearer on the hard and relatively-inflexible seat.

9 Claims, 3 Drawing Sheets

(56) References Cited

U.S. PATENT DOCUMENTS

| | | | | |
|---|---|---|---|---|
| 7,430,766 | B2 * | 10/2008 | Coccia | 2/228 |
| 7,707,659 | B2 * | 5/2010 | Africa et al. | 2/267 |
| 7,739,754 | B2 * | 6/2010 | Garneau | 2/466 |
| 7,757,311 | B2 * | 7/2010 | Garneau | 2/466 |
| 7,784,116 | B2 * | 8/2010 | Gallo et al. | 2/267 |
| 7,950,169 | B2 * | 5/2011 | Holt et al. | 36/29 |
| 8,042,197 | B2 * | 10/2011 | Maier | 2/228 |
| 2005/0210570 | A1 * | 9/2005 | Garneau | 2/466 |

* cited by examiner

AIR-CUSHIONED SHORTS FOR CYCLING

BACKGROUND

1. Field of the Invention

The present invention relates to cycling. More particularly, this invention pertains to shorts that include air-cushioning for significantly reducing the discomfort and possible risks to the rider often posed by the relatively hard seat of a cycle.

2. Description of the Prior Art

While bicycle riding, or cycling, is almost-universally appreciated as a high quality source of fitness and health, it can pose health issues, especially for male cyclists. Although a generally low impact activity, the interface between rider and a racing-type seat can contribute to not-insubstantial physical harm.

A racing-style seat is designed to provide minimal impediment to the rider's ability to "pump" his legs for maximum speed and power when, for example, racing or climbing a hill. This dictates that it present a minimal profile in the horizontal plane to offer maximum clearance for the insides of the rider's legs. This is in contrast to other types of recreational cycles that provide a well-padded seat of generally-triangular design. Such seats are found on cycles designed for leisurely coasting and are quite suitable for sightseeing rather than racing or strenuous workouts.

The seat of a racing-type cycle is generally horizontally-elongated and aligned with the frame of the cycle. It is characterized by a transverse cross-section of inverted u-shape for maximum leg clearance as discussed above. The described shape allows the unfettered pumping of the cyclist's legs. In keeping with the objective of minimizing interference with the pumping of the rider's legs, the seat of a racing-type cycle is minimalist, formed of a cast metal frame with an overlying cover of leather or synthetic fabric. Minimal allowance is made for cushioning material of any kind.

While a seat of the type described in the preceding paragraph is advantageous for the aggressive rider who may often be standing throughout the majority of his workout, such design poses certain well-recognized risks. The seat of a racing-type cycle is only minimally-functional in terms of cushioning when one sits on it for extended periods of time. This is especially the case for male riders whose physiology is not particularly well suited for resting on a hard seat. Riding can cause the weight of the upper body of a male rider to press the rider's prostate and gonadal region down upon the hard seat, resulting in medically-recognized harm.

Current designs of cycling shorts for men include padding of, for example, foam rubber, synthetic fabric or fiber that extends from the rider's seat to cover the crotch region. While offering some comfort and protection, such shorts are not particularly suitable for use by casual riders over long distances as the padding is subject to compression and can become hard and ineffective as a cushion with extended use.

SUMMARY OF THE INVENTION

The present invention addresses the preceding and other shortcomings of the prior art by providing cycling shorts of novel design. Such shorts include a first fabric portion for covering at least a first upper leg of a wearer and extending to the wearer's waist and a second fabric portion for covering at least a second upper leg of a wearer rider and extending to the wearer's waist.

The first and second portions converge to a seam defining an axis of symmetry of the shorts. A pad is affixed to the inner surface of the shorts. The pad comprises integral seat section and crotch sections. The pad is aligned with respect to the axis of symmetry of the shorts so that the crotch section overlies the wearer's crotch region. The pad includes a interior chamber for receiving and retaining pressurized air.

The preceding and other features of the invention will become further apparent from the detailed description that follows. Such description is accompanied by a set of drawing figures. Numerals of the drawings, corresponding to those of the written description, point to the features of the invention with like numerals referring to like features throughout both the written description and the drawings.

DETAILED DESCRIPTION OF THE PREFERRED EMBODIMENT

Figure 1A:
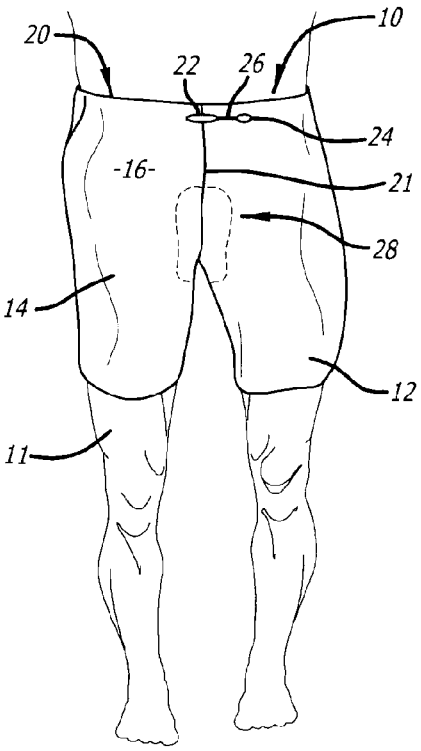
FIGS. 1A and 1B are perspective frontal and rear views of a pair of cycling shorts (on a wearer) in accordance with the invention.
Figure 1B:
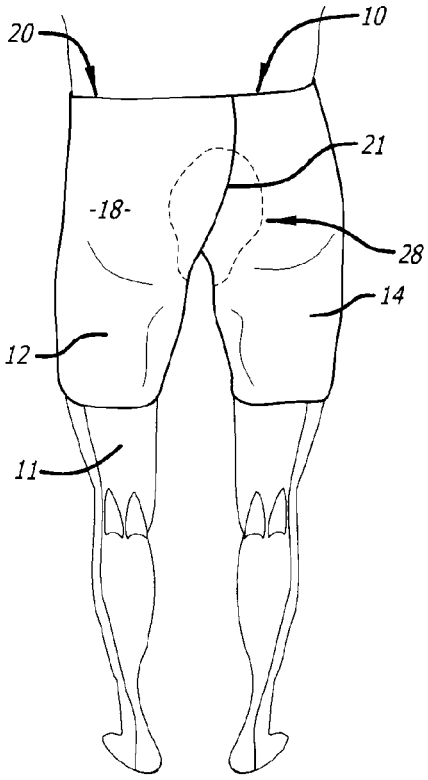

FIGS. 1A and 1B are perspective frontal and rear views, respectively, of cycling shorts 10 (on a wearer 11) in accordance with the invention. The shorts 10 of FIG. 10 are of the men's classic compression-fit design that generally comprises first and second (left and right) fabric portions 12 and 14 that cover portions of the legs of a wearer. The fabric portions 12, 14 upwardly converge, forming (at the front) a frontal portion or panel 16 and a seat portion or panel 18. The upper edge of the shorts 10 comprises a waistband 20. A seam 21 running between the portion of the waistband 20 adjacent the frontal panel 16 through that adjacent the seat panel 18 defines the axis of symmetry of the cycling shorts 10. As shown in FIGS. 1A and 1B, the seam 21 may represent an actual sewn seam that joins the two fabric portions 12 and 14. It may also be a "virtual" seam in the event that another physical seam configuration joins the fabric portions 12 and 14 to form the frontal and seat panels 16, 18. It shall be understood that, regardless of the configuration adopted for physical joinder of the fabric portions 12 and 14 to form the completed cycling shorts, the term seam is understood to be either a physical or virtual manifestation that coincides with the axis of symmetry of the cycling shorts 10 as is clearly the case as illustrated in FIGS. 1A and 1B.

The shorts of FIGS. 1A and 1B are preferably of elasticized synthetic fabric such as LYCRA® and a waistband 20 may be reinforced with elastic material or a drawstring to secure the shorts 10 to the rider's waist.

The particular type of shorts illustrated in FIGS. 1A and 1B are, as mentioned earlier, of classic compression-fit design that terminate above a wearer's knees and offer a skin-tight fit that is especially suitable for racing. Numerous other designs of cycling shorts are recognized as more-or-less standard and, as will be seen, adaptable to the features that characterize the invention. Such alternative cycling short designs include so-called baggy and bib shorts.

Figure 3:
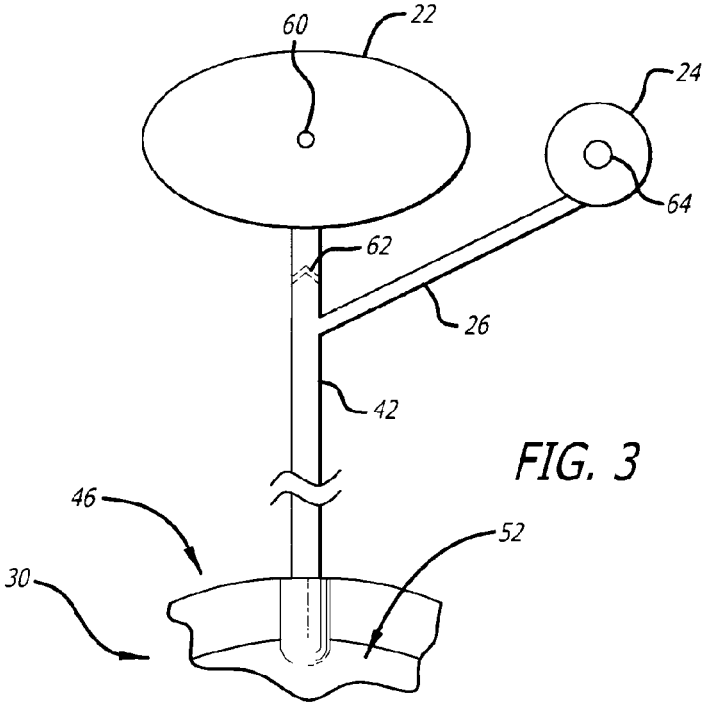
FIG. 3 is a schematic view of the air pump apparatus for cycling shorts in accordance with the invention.

As seen in FIG. 1A, a pump 22 is centrally fixed to the upper frontal panel 16 in close proximity to the waistband 20. Offset from the pump 22 is a relief valve 24. The pump 22 communicates with the relief valve 24 through a connecting conduit segment 26. The overall arrangement of the system for selectively pumping air into the shorts 10 for air-cushioning is illustrated in FIG. 3 below.

Figure 2A:
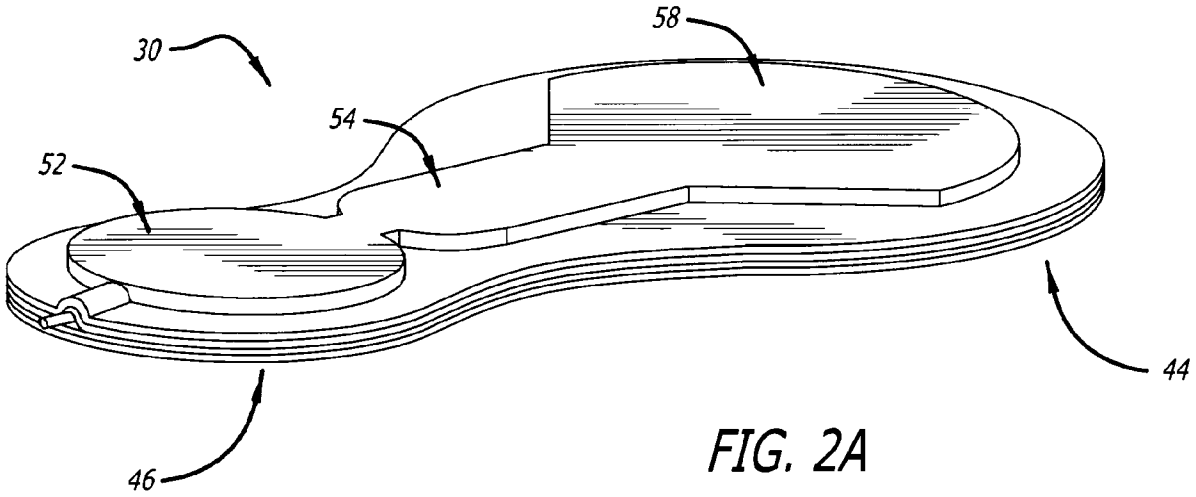
FIGS. 2A and 2B are perspective assembled and exploded perspective views, respectively, of the interior pad of cycling shorts in accordance with the invention.

A pad (not visible in FIG. 1A or 1B) is secured to the interior of the shorts 10 by stitching, indicated by a continuous stitch line 28 that spans both the frontal and seat panels 16 and 18 respectively. Detailed views of the interior pad for air-cushioning of the shorts 10 are provided in FIGS. 2A and 2B, the view of FIG. 2A being a perspective view of an assembled interior pad 30 and that of FIG. 2B being an exploded perspective view of the pad 30 illustrating its internal details.

Figure 2B:
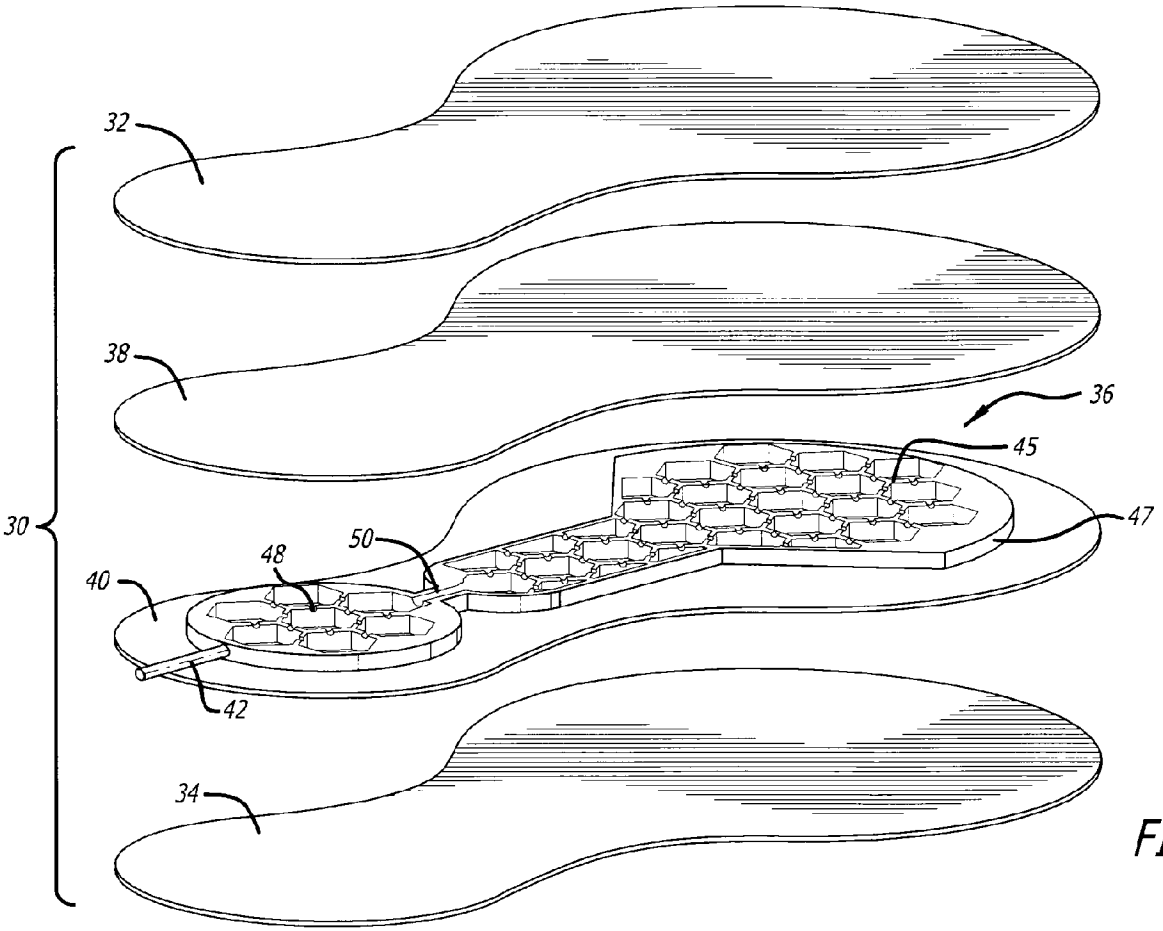

Referring in particular to FIG. 2B, the pad 30 comprises a composite, multi-layered device. Fabric outer layers 32, 34 surround an internal chamber 36 formed between mating internal layers 38, 40 of impermeable material. The internal layers 38, 40 are preferably formed of molded silicone rubber for flexibility and may be secured to one another by one or more of a number of conventional sealing processes such as gluing or fusion, thereby assuring that the internal chamber 36 formed between the internal layers 38, 40 is air tight. Designed apertures are provided within the internal chamber 36 for communication with an input/output air conduit 42 and for guiding the distribution of cushioning air within the internal chamber 36.

Returning to FIG. 2A, the assembled pad 30 is shaped to include relatively distinctly shaped enlarged seat and narrow crotch regions 44 and 46 respectively. When fixed to the shorts 10, the seat region 44 generally lies within the seat portion or panel 18 while the crotch region 46 extends from the seat portion to the frontal portion or panel 16.

Returning to the exploded perspective view of FIG. 2B, the internal chamber 36 is seen to be subdivided into a honeycombed plurality of cells, each cell being divided from the others by an arrangement of cell-defining internal walling 45 contained within a shaped outer wall 47. A variety of apertures and passages are provided within the internal chamber 36 to permit the controllable inflation of the pad 30 both prior to and during use. Recognizing that the first and second layers of impermeable material 38, 40 are sealed to one another when assembled, pressurized air can enter (and exit) the chamber 36 via the input/output conduit 42 through an accommodating aperture in the outer wall 47. Once within the boundary formed by the outer wall 47, such air can circulate under pressure within the internal chamber 36, guided throughout the cell-defining internal walling 45 via notches at upper edges of cells (such as a representative notch 48) and through a duct 50 that joins a front portion chamber 52 to a mid-portion chamber 54 of the internal chamber 36.

The chamber 36 is controllably pressurized by means of the manually-operable pump 22 that is fixed to the frontal panel 16 of the cycling shorts 10. Viewing FIGS. 2A and 2B together, it can be seen that the internal chamber 36 of the pad 30 is apportioned into a number of distinct sections to provide necessary protection and comfort for a wearer during cycling. Proceeding from front to rear, the front portion chamber 52 underlies and cushions the gonadal region of a wearer. It is connected by the internal duct 50 to the mid-portion chamber 54 that underlies the prostate area of a male cyclist. The relatively-narrow mid-portion chamber 54 merges with an enlarged seat region chamber 58 that underlies the rear or seat of the cyclist.

The honeycombed structure of the interior chamber 36 wherein cells permit limited transmission and redistribution of pressurized air between the various regions or sub-chambers described above assures that, once inflated, the interior chamber 36 will continue to support and cushion the various anatomical regions that can be negatively affected by pressure exerted by a hard racing-type seat on a rider. Were it not for the cellular structure with small ducts permitting only limited redistribution of air within the interior chamber 36 as the rider contacts the seat, air within the chamber 36 would invariably be disadvantageously distributed, largely negating any desired cushioning effect. Without the honeycombed internal structure of the chamber 36, air would be readily forced away from the regions underlying portions of the rider's anatomy that press hardest against the hard cycle seat toward those that exert lesser pressure. For example, one would expect lateral migration of pressurized air away from the centerline of joinder of the fabric portions 12, 14 of the shorts 10. This is both wasteful of the cushioning effect and degrades the effectiveness of the air cushion. Were one to attempt to compensate for this migration of cushioning effect, overinflation of the chamber 36 would undoubtedly produce other deleterious effects.

FIG. 3 is a schematic view of the air pump apparatus of the invention. Such apparatus enables the cyclist to inflate the pad 30 by an amount that provides comfort and protection. The apparatus includes the bladder-like pump 22, commonly known as a "palm pump" which includes a small aperture 60 for admitting air via suction when pressed. The input/output conduit 42 includes an internal trapping air valve 62 that limits air transfer, permitting air to flow solely from the bladder-like pump toward and/or into the pad 30. The relief valve 24 is connected to the input/output conduit 42 by means of the conduit 26. It includes a flap 64 that permits the rider to reduce pressure within the chamber 36 as desired. This prevents overinflation of the pad 30 that can be harmful in itself to the cyclist.

Impact testing using INSTRON DYNATUP® instrumented impact test and data acquisitions software has shown that a pad in accordance with the invention as described, formed of laminated layers comprising an exterior of soft fabric and internal layers of impermeable material forming an internal chamber for receiving pressurized air, above can substantially reduce the loading in the presence of an applied force. Such load reduction is achieved by an increase in the degree of displacement (as compared with wood, as well as the padding employed in the following models of cycling shorts: SUGOI®-XL, SUGOI®-L women and CANARI®-M) that is absorbed by an air-cushioned pad in accordance with the invention. Load reductions of 45 to 57 percent were observed with in a pad in accordance with the invention inflated in the range of 30 to 40 p.s.i. The other paddings (including wood) offered load reductions in the range of 0 to 27 percent.

Thus it is seen that the air-cushioned cycling shorts of the invention provide a means for protecting a rider from the potentially damaging effects of a racing-type seat. By utilizing the teachings of this invention, the cyclist can enjoy the manifold health benefits of cycling without substantial fear of harmful side effects.

While the invention has been described with reference to its presently preferred embodiment, it is not limited thereto. Rather, this invention is limited only insofar as it is defined by the following set of patent claims and includes within its scope all equivalents thereof.

What is claimed is:

1. Cycling shorts comprising, in combination:

a) a first fabric portion for covering at least the upper region of one leg of a wearer and extending to the wearer's waist;

b) a second fabric portion for covering at least the upper leg region of the other leg of the wearer and extending to the wearer's waist;

c) said first and second fabric portions converging to a seam defining an axis of symmetry of said shorts;

d) a pad affixed to an inner surface of said shorts, said pad comprising integral seat and crotch sections;

e) said pad being aligned with respect to said axis of symmetry of said shorts so that said crotch section of said pad overlies the wearer's crotch region; and f) said pad including a interior chamber for receiving and retaining pressurized air, said interior chamber having a plurality of internal honeycombed sections for minimizing air flow therebetween.

2. Cycling shorts as defined in claim 1 wherein said interior chamber of said pad further includes:

a) a first layer of impermeable material having a periphery defining said integral seat and crotch sections of said pad;

b) a second layer of impermeable material having a matching periphery defining said integral seat and crotch sections of said pad;

c) said first and second layers of impermeable material being sealably joined at their peripheries to enclose said interior chamber; and d) said interior chamber having a plurality of internal honeycombed sections for minimizing air flow therebetween.

3. Cycling shorts as defined in claim 2 wherein said internal chamber further includes:

a) an enlarged seat chamber;

b) a narrowed crotch chamber; and c) said enlarged seat and narrowed crotch chambers being symmetrical with respect to said axis of symmetry of said shorts.

4. Cycling shorts as defined in claim 3 wherein said narrowed crotch chamber further comprises:

a) a mid-portion chamber for overlying the prostate region of a wearer;

b) a front portion chamber for overlying the gonadal region of a wearer; and c) a neck portion chamber for joining said mid-portion chamber to said front chamber.

5. Cycling shorts as defined in claim 4 wherein said pad further includes:

a) a first fabric layer having a periphery defining said integral seat and crotch sections of said pad;

b) a second fabric layer having a periphery defining said integral seat and crotch sections of said pad; and c) said first and second fabric layers overlying the opposed layers of impermeable material defining said interior chamber.

6. Cycling shorts as defined in claim 5 further including:

a) a pump;

b) a conduit;

c) said conduit being arranged to direct pressurized air from said pump to said interior chamber.

7. Cycling shorts as defined in claim 6 further characterized in that:

a) said first fabric portion and said second fabric portion converge to form opposed frontal and seat portions of said cycling shorts; and b) said pump is fixed to an exterior of said frontal portion of said shorts.

8. Cycling shorts as defined in claim 7 further including:

a) a relief valve in communication with said pump; and b) said relief valve is fixed to said exterior of said frontal portion of said shorts.

9. Cycling shorts comprising, in combination:

a) a first fabric portion for covering at least the upper region of one leg of a wearer and extending to the wearer's waist;

b) a second fabric portion for covering at least the upper leg region of the other leg of the wearer and extending to the wearer's waist;

c) said first and second fabric portions converging to a seam defining an axis of symmetry of said shorts;

d) a pad affixed to an inner surface of said shorts, said pad comprising integral seat and crotch sections;

e) said pad being aligned with respect to said axis of symmetry of said shorts so that said crotch section of said pad overlies the wearer's crotch region; and f) said pad including a interior chamber for receiving and retaining pressurized air, said interior chamber having a plurality of internal sections configured to minimize air flow therebetween, each internal section having a conduit to enable it to communicate with at least one adjacent internal section.

* * * * *